US006729415B1

(12) United States Patent
Huang

(10) Patent No.: US 6,729,415 B1
(45) Date of Patent: May 4, 2004

(54) PORTABLE ELECTRIC TOOL WITH BI-DIRECTIONALLY MOUNTABLE BATTERY HOLDER

(75) Inventor: San-I Huang, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 10/418,626

(22) Filed: Apr. 18, 2003

(51) Int. Cl.[7] ..... B25B 21/00
(52) U.S. Cl. ..... 173/217; 173/170; 310/50
(58) Field of Search ..... 173/217, 170, 173/171; 310/47, 50; 408/124

(56) References Cited

U.S. PATENT DOCUMENTS 3,734,207 A * 5/1973 Fishbein ..... 173/217
4,091,880 A * 5/1978 Troutner et al. ..... 173/217
4,835,410 A * 5/1989 Bhagwat et al. ..... 307/64
5,553,675 A * 9/1996 Pitzen et al. ..... 173/217
5,671,815 A * 9/1997 Kabatnik et al. ..... 173/217
5,816,121 A * 10/1998 Yoshimizu et al. ..... 81/469
6,102,632 A * 8/2000 Potter et al. ..... 408/124
6,412,572 B2 * 7/2002 Habedank et al. ..... 173/217
6,460,626 B2 * 10/2002 Carrier ..... 173/1

* cited by examiner

*Primary Examiner*—Scott A. Smith
(74) *Attorney, Agent, or Firm*—Dellett & Walters

(57) ABSTRACT

A portable electric tool with a mountable bi-directionally battery holder has a head, a handle, a tool holder and a battery holder. The tool holder is connected to a motor and is securely mounted on the head, and the handle is integrally formed with the head and has a bottom surface and a dovetail key. The battery holder is mounted on the bottom surface of the handle and has a pair of parallel channels that can contain the dovetail keys of the handle. When using the portable electric tool with a mountable bi-directionally battery holder in accordance with the present invention, users can rotate the connecting direction of the battery holder to provide a convenient way in use.

3 Claims, 5 Drawing Sheets

PORTABLE ELECTRIC TOOL WITH BI-DIRECTIONALLY MOUNTABLE BATTERY HOLDER

BACKGROUND OF THE INVENTION

1. Field of the Invention

The present invention relates to a portable electric tool with a battery holder, more particular to a bi-directionally battery mounted to a portable electric tool.

2. Description of Related Art

An electric tool, such as an electric drill, is connected to a power supply whereby the tool can output large force to drill or work. A conventional electric tool has a plug with a cable connected to the power supply, but the cable and the plug are not convenient when using the tool outdoors and the length of the cable will limit the working place. So an electric tool with a battery is invented. With reference to FIGS. 4 and 5, the electric tool (40) with a battery holder (50) has a head (41), a tool holder (42), a motor (not shown), a hollow handle (43) and a switch (44). The head (41) has a top surface (not numbered) and the tool holder (42) connected to the motor is mounted on the top surface. The tool holder (42) can connect to various types of drills (not shown). The hollow handle (43) is integrally formed with the head (41). A connecting cover (431) is formed transversely and integrally formed with the hollow handle (43). An electric circuit and wiring (not shown) are housed in the hollow handle (43). The battery holder (50) can provide power to the electric tool (40) and has a top surface (not numbered), a sidewall surface (not numbered) and a protrusion (51). The width of the top surface is smaller than the width of the whole battery holder (50). The protrusion (51) is integrally formed with the top surface of the battery holder (50) and has four sides (not numbered), four top edges (not numbered) and four electrical conduction contacts (52). Each electrical conduction contact (52) is mounted on a respective side and near the top edge. A position element (53) is mounted on a side and has a hook (531) extending out and near the top surface.

When the protrusion (51) is inserted into the hollow handle (43), the connecting cover (431) covers the top surface of the battery holder (50) and the electrical conduction contacts (52) face the circuit inside the hollow handle (43). When pressing the switch (44), the electric conduction contacts (52) will contact the circuit mounted inside the hollow handle (43) so the portable electric tool (40) will work.

The battery holder (50) and the conventional portable electric tool (40) are fixedly connected and the direction cannot be changed. When using the conventional portable electric tool (40), the battery holder (50) often collides with a wall and it is not convenient to handle the portable electric tool (40).

The present invention provides a portable electric tool with a bi-directionally mountable battery holder to mitigate or obviate the aforementioned problem.

SUMMARY OF THE INVENTION

The primary objective of the present invention is to provide a portable electric tool with a bi-directionally mountable battery holder. The battery holder is mounted on the bottom surface of the handle and has two channels that can receive two dovetail keys formed on the handle.

When using the portable electric tool in accordance with the present invention, users can change the connecting direction of the battery holder to provide a convenient way to use the portable electric tool.

Other objects, advantages and novel features of the invention will become more apparent from the following detailed description when taken in conjunction with the accompanying drawings.

DETAILED DESCRIPTION OF THE PREFERRED EMBODIMENT

Figure 1:
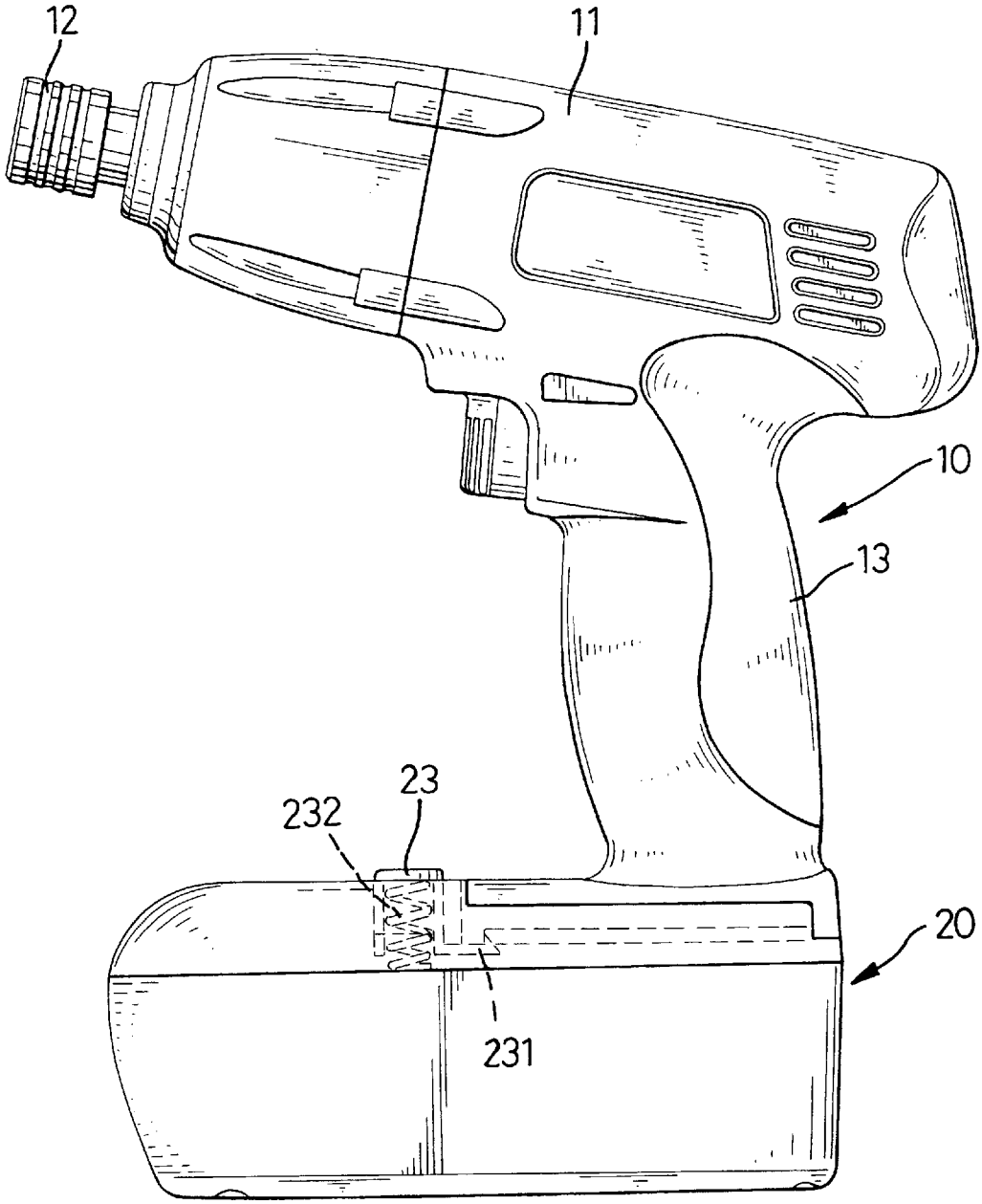
FIG. 1 is a side plan view of a portable electric tool with a bi-directionally mountable battery holder in accordance with the present invention.
Figure 2:
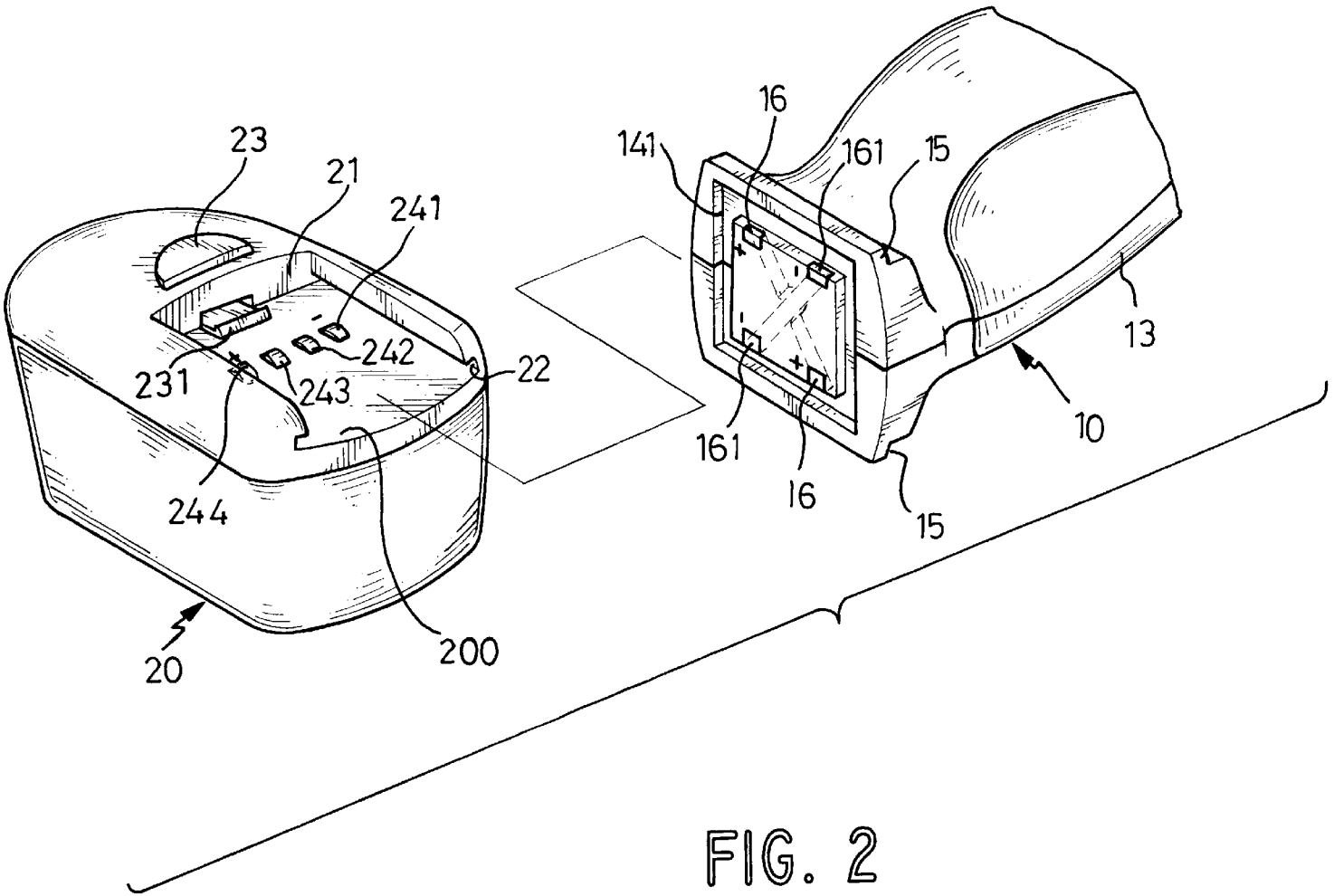
FIG. 2 is an enlarged exploded perspective view of the battery holder in FIG. 1.

With reference to FIGS. 1 and 2, a portable electric tool (10) with a bi-directionally mountable battery holder in accordance with the present invention has a head (11), a tool holder (12), a handle (13) and a battery holder (20). The connecting direction of the battery holder (20) of the electric tool (10) can be rotated 180° to provide a convenient way to handle the portable electric tool (10) in use.

The head (11) has a front surface (not numbered), and an electric motor, an actuation switch and an electric circuit are mounted in the head (11) in a conventional manner and are not further described. The tool holder (12) is rotatably mounted on the front surface of the head (11). The tool holder (12) connected to the electric motor (not shown) is connected to various types of drills and provides a revolving force.

The handle (13) is integrally formed with the head (11) which is longitudinally formed with the handle (13). The handle (13) has a bottom surface (not numbered), four bottom edges (not numbered), an engaging element, such as two dovetail keys (15), a bottom concavity (not numbered) with four inner edges (not numbered) and a conduction piece (not numbered) with four edges (not numbered). The dovetail keys (15) are respectively formed integrally on two of the bottom edges of the handle (13), which are parallel with each other. The bottom concavity is defined in the bottom surface of the handle (13), and the conduction piece is mounted in the bottom concavity. The conduction piece has a size smaller than that of the bottom concavity, such that a recess (141) is defined between the inner edges of the bottom concavity and the four edges of the conduction piece. The conduction piece has two positive electric terminals (16) and two negative electric terminals (161). The two positive terminals (16) are connected to each other, and the two negative terminals (161) are also connected to each other. The two positive terminals (16) are opposed to each other and the two negative terminals (161) are opposed to each other and adjacent the positive terminals (16).

The battery holder (20) has a top surface (not numbered), a curved side (not numbered), a chamber (21), a locking element (23) and four electric contacts (241, 242, 243, 244). The chamber (21) is defined in the top surface and near the curved surface. The chamber (21) has an opening end (200), a short edge (not numbered), and two long edges (not numbered) that are parallel with each other. A through hole (not numbered) is defined through the short edge. A receiving element, such as two channels (22) are respectively defined along the long edges. The locking element (23) is mounted on the top surface and has a button (not numbered) with an inside surface (not numbered), an L-shaped extending hook (231) and a spring (232). The spring (232) is attached to the inside surface of the button and is mounted inside the battery holder (20). The L-shaped extending hook (231) is securely mounted on the inside surface of the button and near the spring (232), and extends out from the through hole. The electrical contacts (241, 242, 243, 244) are mounted on the bottom of the chamber (21) on the top surface and are arranged in a line. The first electrical contact (241) is negative and can contact with the negative electrical terminal (161) defined on the conduction piece of the handle (13). The fourth electrical contact (244) is positive and can contact with the positive electrical terminal (16) defined on the conduction piece of the handle (13). The second and the third electrical contacts (242, 243) are used for recharging the batteries to serve as charging electrical terminals. When using the portable electric tool with the bi-directionally battery holder in accordance with the present invention, the dovetail keys (15) of the handle (13) are inserted into the channels (22) in the battery holder (20). The L-shaped extending hook (231) engages with the recess (141) defined in the bottom surface of the handle (13). Consequently, one of the positive terminals (16) will contact with the positive contact (244), and one of the negative terminals (161) will contact with the negative contact (241).

Figure 3:
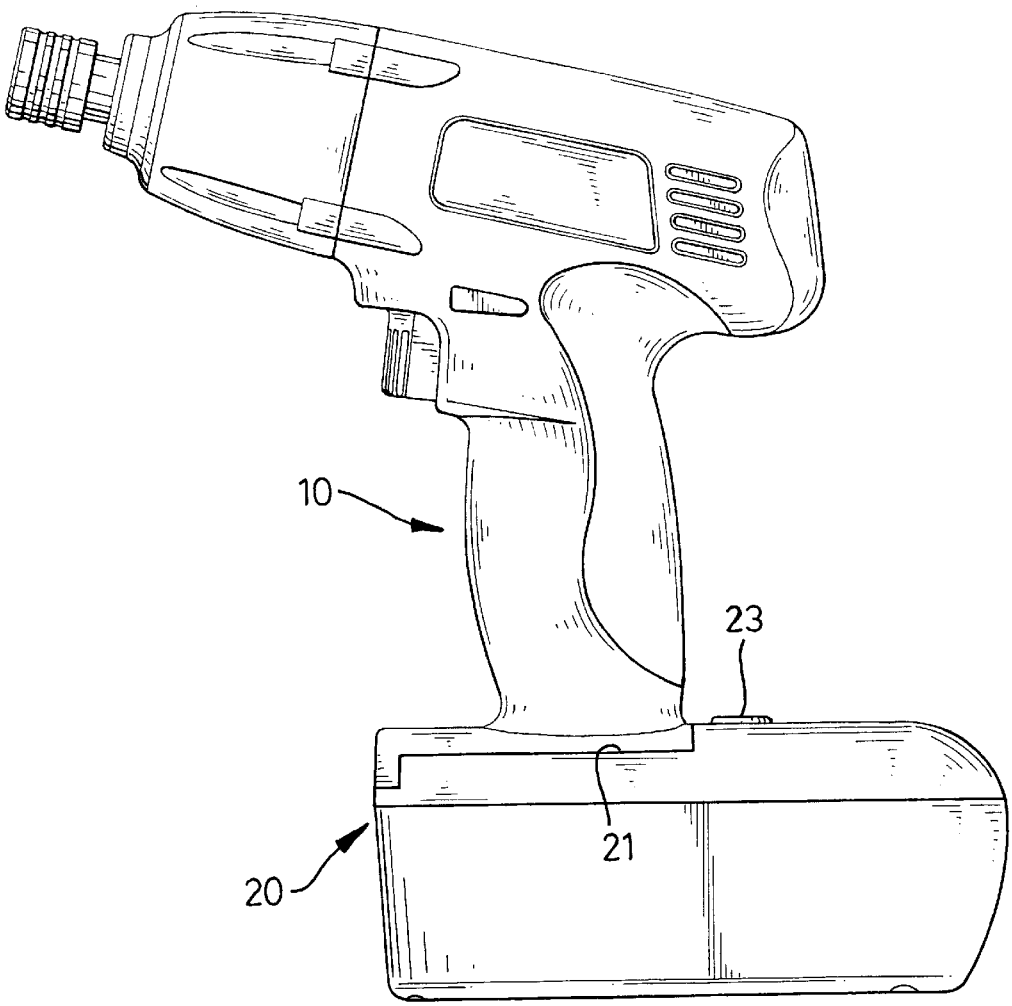
FIG. 3 is a side plan view showing when the battery holder is connecting in an opposite direction to that shown in FIG. 1.
Figure 4:
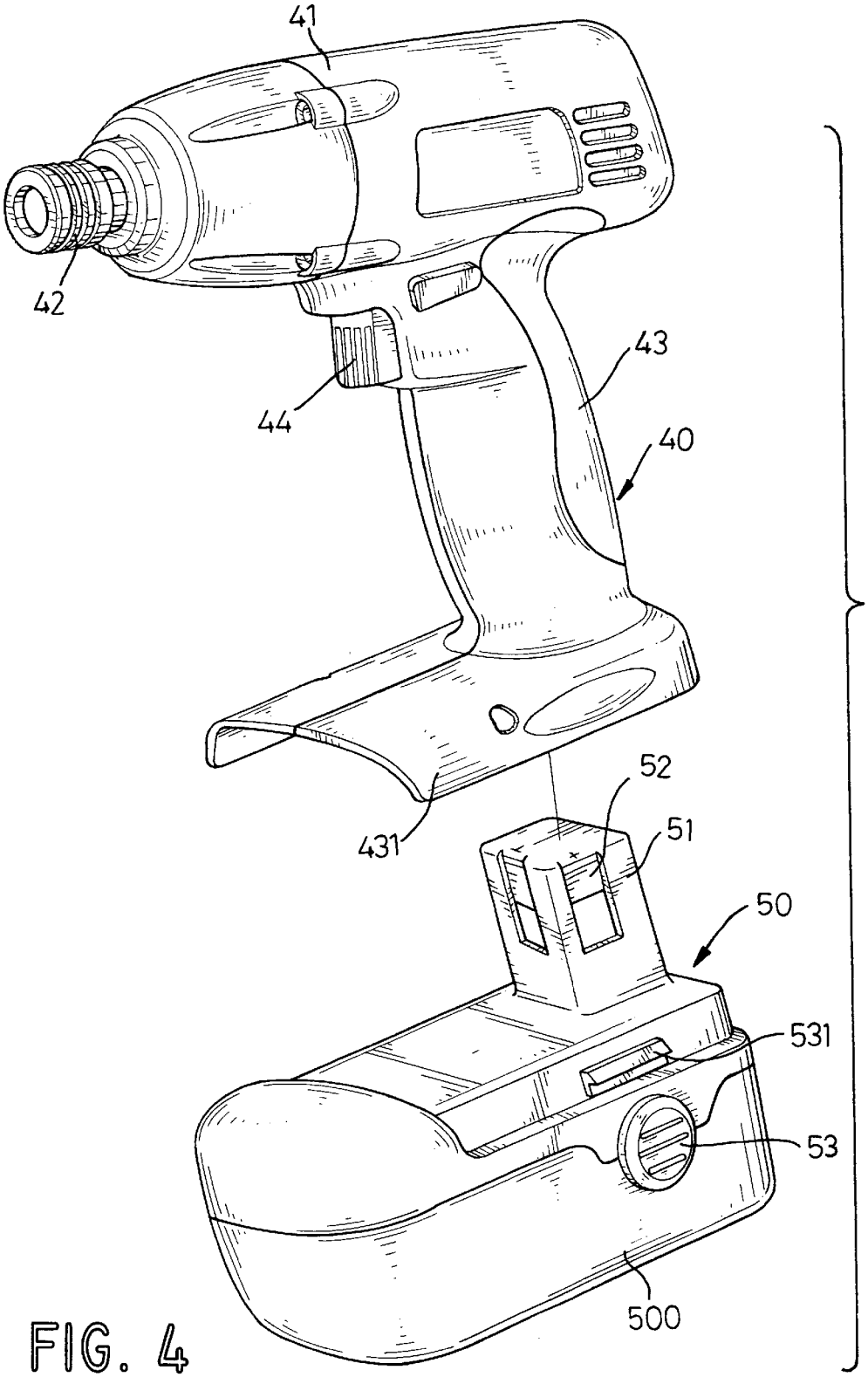
FIG. 4 PRIOR ART
FIG. 4 is an exploded perspective view of the conventional electric tool with a battery holder.
Figure 5:
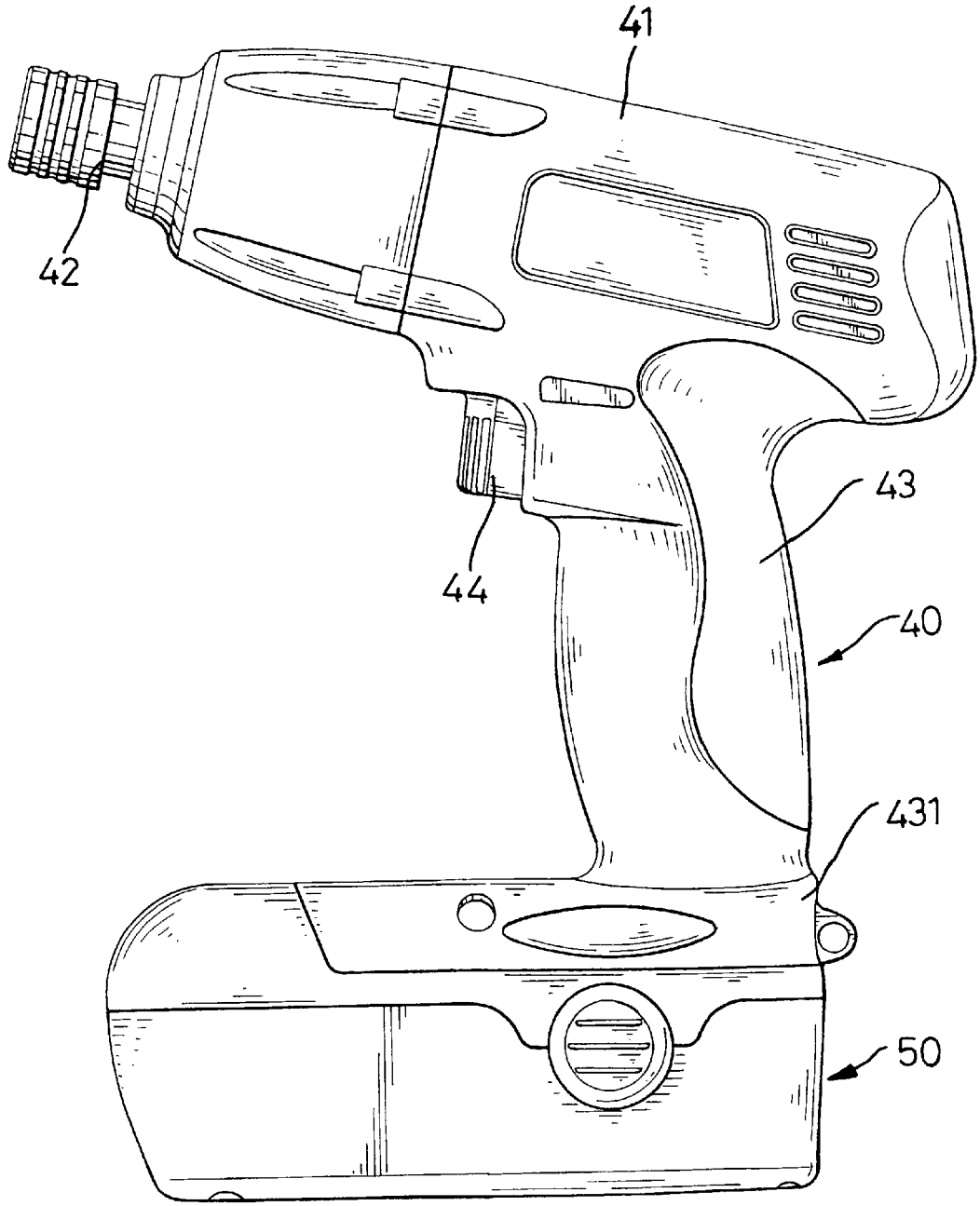
FIG. 5 PRIOR ART
FIG. 5 is a side plan view of the conventional electric tool with the battery holder in FIG. 4.

With reference to FIGS. 2 and 3, when pressing the outside surface of the button of the locking member (23), the L-shaped extending hook (231) will release from the recess (141) in the handle (13). Accordingly, the dovetail keys (15) of the handle (13) can be pulled out from the channels (22) in the battery holder (20). Then, the dovetail keys (15) on the handle (10) can be inserted into the channels (22) in an opposite direction, whereby the positive terminal (16) will contact the positive contact (244) and the negative terminal (161) will contact the negative contact (241).

When users use the portable electric tool with the bi-directionally battery holder in accordance with the present invention, users can connect the battery holder (20) dependent on their needs and a working position of the portable electric tool will not clash with a nearby wall. Thus the portable electric tool (10) can provide a convenient way to use the electric tool (10) and will not be limited by working places. The dovetail keys (15) and channels (22) can be tenons and mortises, inverted T-like, semi-circular, and so on without departing from the spirit of the invention.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. An portable electric tool with a mountable bi-directionally battery holder comprising a head having a front surface;

a motor mounted in the head;

a switch mounted on the head and electrically connected to the motor;

a tool holder connected to the motor and mounted on the front surface of the head;

a handle integrally formed with the head and having a bottom surface with two opposite edges;

a bottom concavity with four inner edges defined in the bottom surface;

an engaging element mounted on the bottom surface; and a conduction piece received in the bottom concavity and having a periphery; and a recess defined between the inner edges of the bottom concavity and around the periphery of the conduction piece;

a battery holder detachably attached to the handle to provide an electrical power to the motor and having a top surface;

a receiving element mounted on the top surface and detachably engaging with the engaging element on the bottom surface of the handle to make the handle have a capability of adjusting 180° relative to the battery holder; and a locking element mounted on the top surface and engaging with the recess in the handle and having a button with an inside surface;

a spring mounted in the battery holder and abutting against the inside surface of the button; and an L-shaped extending hook portion mounted on the inside surface of the button and engaging with the recess in the bottom surface of the handle.

2. The portable electric tool with a mountable bi-directionally battery holder as claimed in claim 1, wherein the conduction piece has two parallel edges;

two positive electrical terminals connected to each other; and two negative electrical terminals connected to each other, being opposite to each other and adjacent the positive terminals; and the battery holder further comprises a chamber defined in the top surface and having a short edge;

two parallel long edges; and an opening end formed opposite the short edge; and four electrical contacts mounted in the chamber in the top surface, selectively contacting with two of the electrical terminals and comprising a positive contact contacting with one of the positive terminals mounted on the conduction piece on the bottom surface of the handle;

a negative contact contacting with one of the negative terminals mounted on the conduction piece on the bottom surface of the handle; and two charging electrical contacts used for charged.

3. The portable electric tool with a mountable bi-direction battery holder as claimed in claim 2, wherein the engaging element of the handle is two dovetail keys integrally formed on the opposite edges of the bottom of the handle; and the receiving element of the battery holder is two channels respectively defined along the parallel long edges to selectively receive the dovetail keys on the handle respectively.

* * * * *